US006581350B2

(12) United States Patent
Dean

(10) Patent No.: US 6,581,350 B2
(45) Date of Patent: Jun. 24, 2003

(54) FLOOR CONSTRUCTION FOR AN AMUSEMENT RIDE

(75) Inventor: John J. Dean, Springfield, OR (US)

(73) Assignee: Ride Development Company, Independence, OR (US)

( * ) Notice: Subject to any disclaimer, the term of this patent is extended or adjusted under 35 U.S.C. 154(b) by 131 days.

(21) Appl. No.: 09/802,555

(22) Filed: Mar. 12, 2001

(65) Prior Publication Data

US 2002/0124512 A1 Sep. 12, 2002

(51) Int. Cl.[7] ..... B60M 1/00

(52) U.S. Cl. ..... 52/480; 52/220.8; 104/53; 191/13

(58) Field of Search ..... 52/480, 177, 181, 52/220.1, 220.8, 506.01, 506.05; 104/53, 88.01, 88.02; 180/2.1; 191/13; 472/27, 88

(56) References Cited

U.S. PATENT DOCUMENTS 3,978,934 A * 9/1976 Schneidinger ..... 180/2
4,324,301 A * 4/1982 Eyerly ..... 180/2 R
4,811,530 A * 3/1989 Eyerly ..... 52/6

* cited by examiner

*Primary Examiner*—Carl D. Friedman
*Assistant Examiner*—Jennifer I. Thissell
(74) *Attorney, Agent, or Firm*—James D. Givnan, Jr.

(57) ABSTRACT

A floor for a bumper car amusement ride is of modular construction. A base of each module may be of wood and has a multitude of openings for inserted reception of threaded studs welded to the underside of sheet metal panels extending lengthwise thereof. Nut elements, upon removal, permit panel removal and replacement. Dielectric spacers on each base insulate metal panels of different polarity. A metal framework supports the floor modules.

6 Claims, 3 Drawing Sheets

FLOOR CONSTRUCTION FOR AN AMUSEMENT RIDE

BACKGROUND OF THE INVENTION

The present invention pertains generally to modular floor construction with the modules having conductive panels in place thereon.

In amusement ride concessions for small electrically powered vehicles termed bumper cars, the power source for each car includes electrically conductive modules in place on a floor with each car provided with electrical pickups or shoes which in circuit with the car motor. Typically, the floors for such amusement rides consist of modules, several square feet in area, in abutment with one another with each module having multiple electrically conductive plates thereon. After a period of operation it is not uncommon that wear or damage will occur to one or more of the modules requiring panel removal and replacement with a new module. Accordingly, while a module may have only one conductive panel damaged, the entire module is removed and replaced at considerable cost and effort to the concession operator. A quantity of replacement modules may be stored on the site or ordered from a supplier with the drawbacks being the original cost of same and the storing of multiple modules ordering modules on an as needed basis which entails shutting down of the amusement ride for one or more days with loss of income. A prior practice in the construction of floor modules is the permanent securement of each conductive panel to the module, often a sheet of plywood. Additional problems can be encountered upon warping of the plywood base causing an uneven surface on the module which is objectionable.

SUMMARY OF THE PRESENT INVENTION

The present invention pertains to a floor module with conductive panels thereon with the panels being individually replaceable on the module.

The present floor module utilizes conductive metal panels on its surface from which current is taken by pickups on an amusement vehicle or bumper car to provide power to the vehicle motor. Both positive and negatively charged panels are in series with one another. The present floor module utilizes a base which is provided with a pattern of openings therethrough for reception of fasteners carried by a conductive panel in place on the module surface. The fasteners retain the conductive panels while permitting individual removal and replacement of a damaged panel. Accordingly, the cost of refurbishing a defective floor module is greatly reduced when compared with the previous practice of replacing an entire floor module with perhaps only one defective panel.

Important objectives of the present invention include the provision of a modular floor comprised of modules each having a base configured to received superimposed, electrically conductive panels in an individually attached manner permitting panel replacement at considerable savings when compared with replacement of the entire floor module; the provision of a floor module for use in a floor of modular construction wherein each module has multiple conductive panels thereon with the panels being detachable upon removal of fastener components from studs carried by the conductive panels to permit convenient panel replacement and prompt return of the module to minimize down time of an amusement ride; the provision of a floor module which may be refurbished by the ride operator with use of common place tools and requiring minimal expertise on the operator's part.

DETAILED DESCRIPTION OF THE PREFERRED EMBODIMENTS

Figures 1, 3, 4, 5:
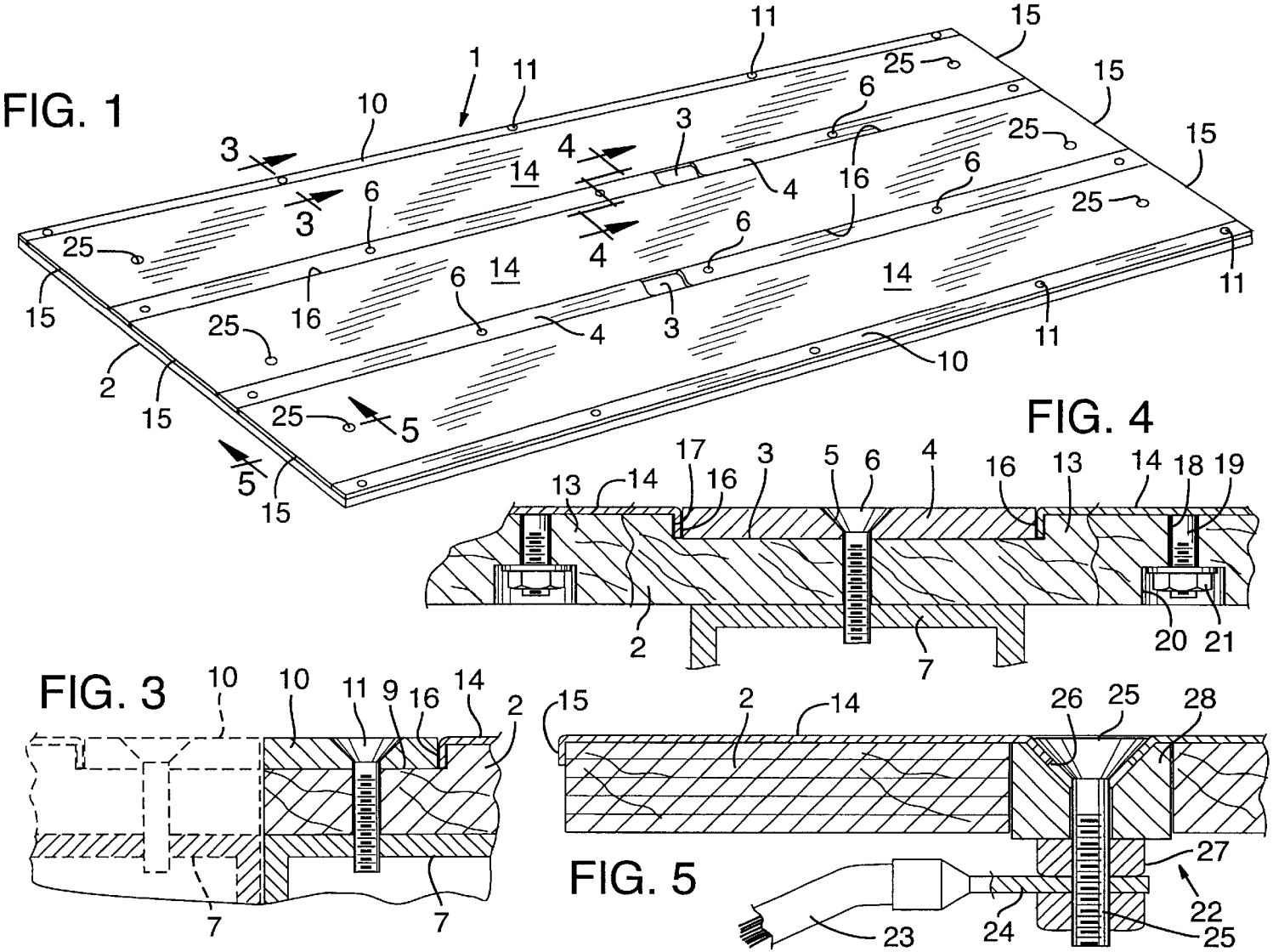
FIG. 1 is a perspective view of the present floor module.
FIGS. 3, 4 and 5 are vertical sectional views taken from FIG. 1.
Figure 6:
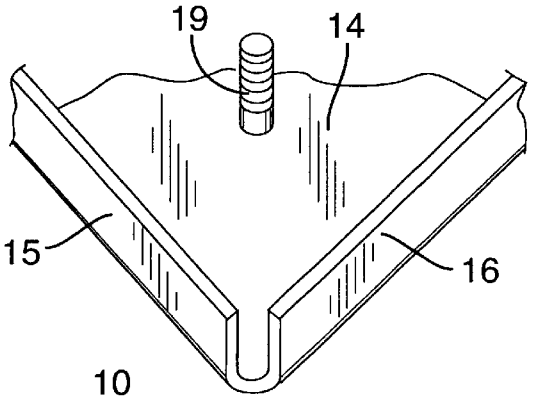
FIG. 6 is a perspective view of a conductive panel segment removed a supporting base and inverted for purposes of illustration.

With continuing attention to the drawings wherein applied reference numerals indicate parts similarly hereinafter identified, the reference numeral 1 indicates generally a floor module, a multitude of which constitute a modular floor for an amusement ride.

Figure 2:
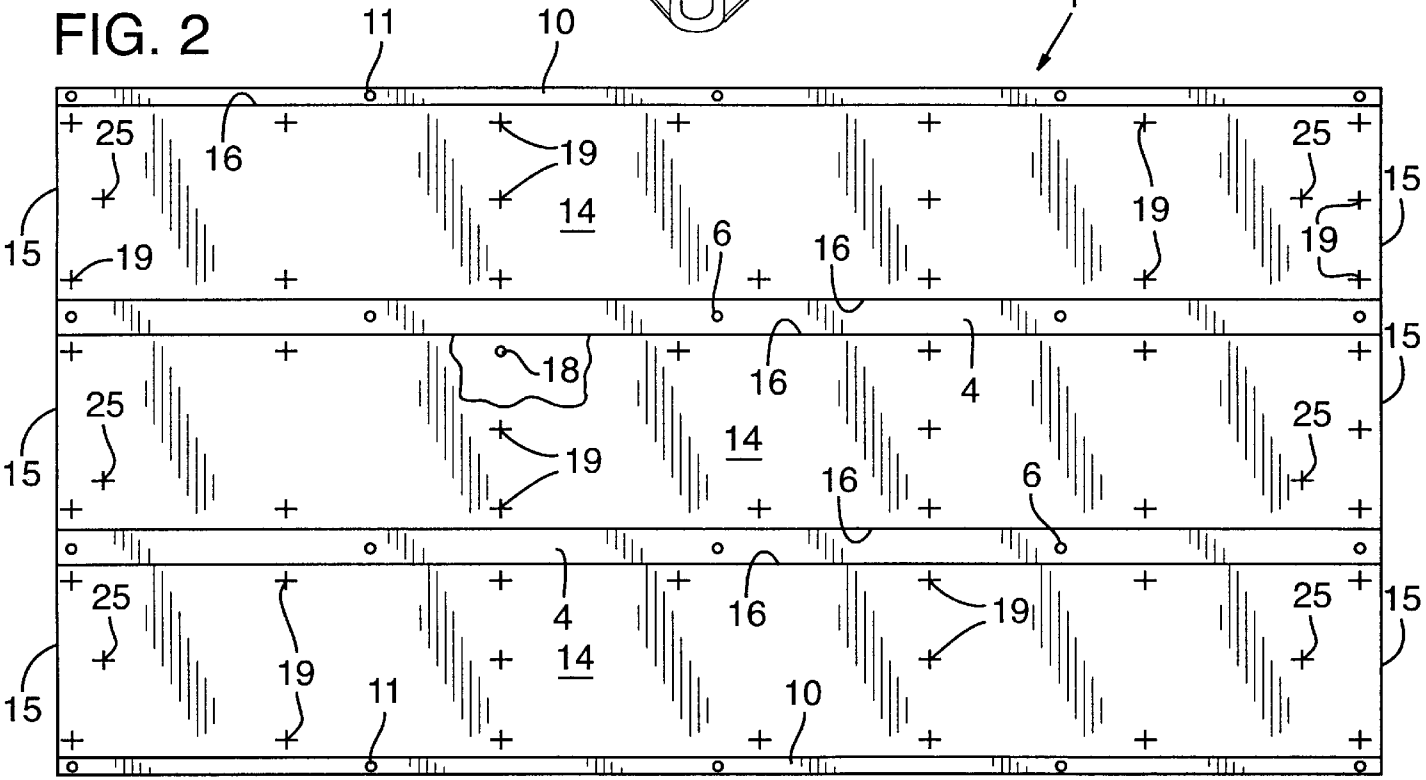
FIG. 2 is a plan view of the module.
Figure 7:
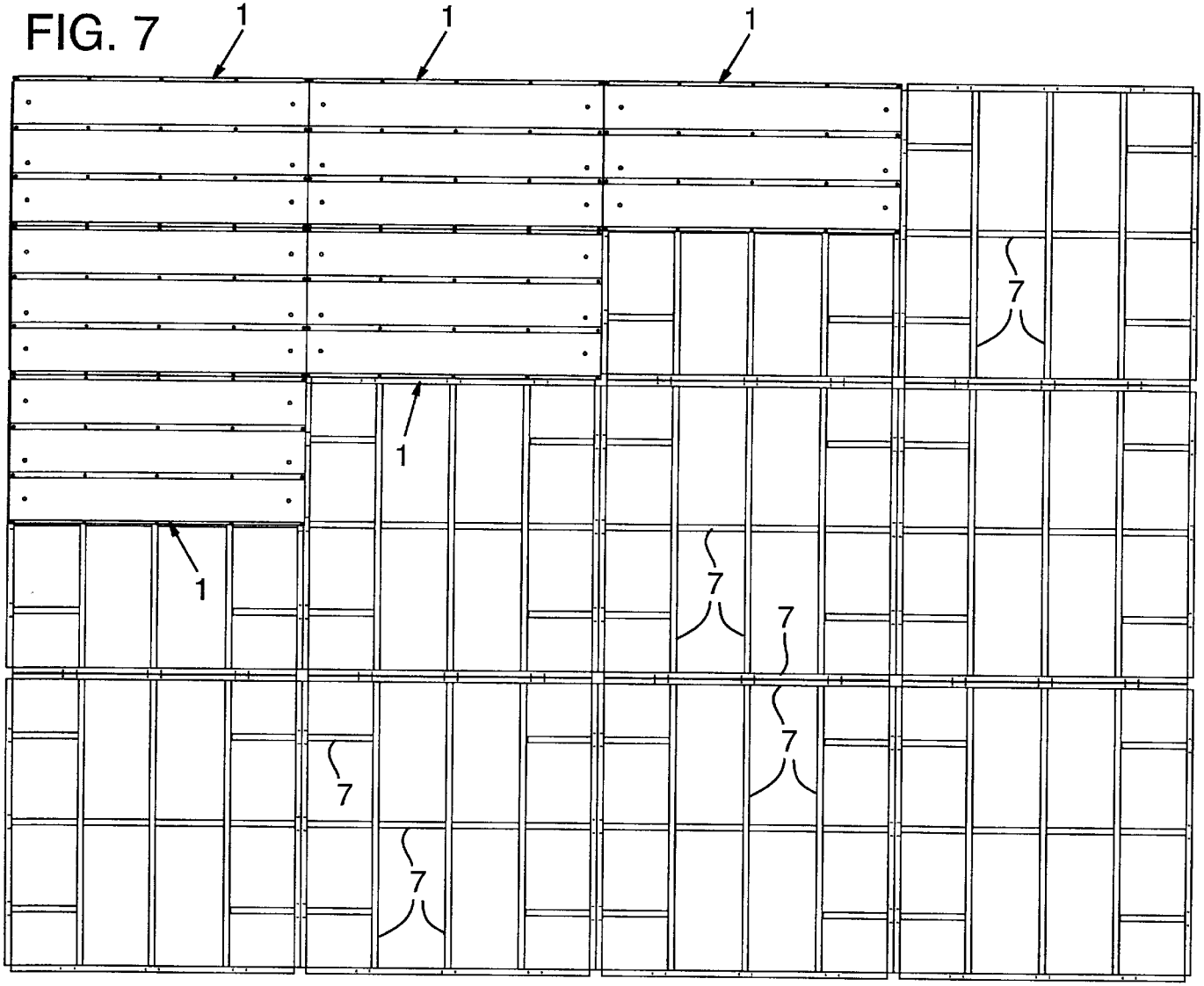
FIG. 7 is a plan view of a partially installed amusement ride floor in place on a supporting framework.

With continuing attention to the module at 1 and FIGS. 1 and 2, a module base at 2 is preferably rectangular, and of dielectric material such as wood, for example. The base defines channels as at 3 cut or formed in the base to receive dielectric spacers at 4 with countersunk openings at 5 spaced therealong for the reception of fasteners 6. In addition to securing spacers 4 to base 2 the fasteners extend into threaded engagement with a tubular metal member 7 of a floor framework shown in FIG. 7. Similarly, dielectric spacers at 10 along the sides of module 1 are secured to underlying base 2 on a shoulder 9 therein by fasteners 11 which terminate in threaded engagement with a tubular framework member 7. The spacers, shoulder and framework are drilled to receive fasteners 11 of the self tapping type. Accordingly, module 1 is secured to framework 7 in a secure yet detachable manner. Dielectric spacers 4 and 10 serve to isolate the following described conductive panels in place on each module as well as conductive panels on laterally adjacent modules of the amusement ride floor.

Raised or elevated areas 13 of the base are defined by channels 3 and shoulders 9 with the raised areas laterally offset or spaced apart from like raised areas with each receiving an overlying conductive panel 14. The conductive panels extend lengthwise of the module with their ends and sides at 15 and 16 abutting the perimeter 17 of each raised area 13 of a module. A suitable material for the conductive panels is stainless steel of 18 gauge with lips 15 and 16 projecting downwardly approximately one-quarter of an inch.

Carried by each conductive panel is a multitude of threaded studs 19 attached as by use of a stud welder, which project downwardly from the panel and extend through an opening 18 in base 2. A counterbore 20 receives a nut 21 and washer to draw panel 14 into snug surface engagement with the upper surface of raised area 13. Counterbore 20 is of a diameter to accept a wrench socket to permit convenient unfastening of nut 21 during removal of a conductive panel 14 from the module. With attention to FIG. 2, it will be seen that each module of the floor is bored at multiple locations 13 to securely affix the panel to base 2 surface yet permitting individual panel removal for refurbishment of a module in the event of damage to a panel.

With attention to FIG. 4 of the drawings, an electrical terminal is indicated generally at 22 and serves to put a conductive panel 14 in circuit with a panel, of like polarity, on an adjacent module. A cable 23 terminates in a blade 24 which is secured to a post 25 which may be the shaft of a threaded fastener of the flat head type recessed or offset below the panel surface apertured at 26. A nut 27 draws the fastener 25 snugly against a conically recessed plug 28 for surface engagement with the marginal surface of opening 26 in panel 14. Installation of the present module is in endwise abutment with an adjacent module of like polarity. The panels 14 of each module will be of alternate polarity for the purpose of providing a current flow to an electrically propelled car, termed bumper car in the United States of America, of an amusement ride. Such cars are equipped with panel engaging shoes which complete a circuit between adjacent panels of the same or adjacent modules.

Repair of a module having a damaged panel 14 entails the removal of nut elements 21 from studs 19 of the damaged panel, whereupon the panel is lifted from the raised area 13 and a new panel substituted with the studs 19 of the new panel being inserted into openings 18 in the panel base.

While a framework 7 is shown, the modules 1 may be set directly on a floor surface with the modules joined by steel stringers inset into the underside of each module.

The panel lips 15, 16 contribute to panel securement in the module base and also avert panel damage by a vehicle carried shoe.

While I have shown but a few embodiments of the invention, it will be apparent to those skilled in the art that the invention may be embodied still otherwise without departing from the spirit and scope of the claimed invention.

Having thus described the invention, what is desired to be secured by a Letters Patent is:

I claim:

1. A module for use in a modular floor, said module comprising, a base having a multitude of upright apertures extending therethrough, conductive panels in place on said base, fasteners depending from the underside of said panels and each occupying one of said upright apertures for panel retention on said base and permitting individual removal of said panels from the base for repair of the module and, spacers of dielectric material between said panels, said spacers constructed with openings, removable fastener assemblies in said openings for attaching said base to a support below the floor.

2. The module claimed in claim 1 wherein each of said panels includes an electrical terminal for series connection with a panel of a like module in the floor.

3. The module claimed in claim 1 wherein said fasteners are threaded and include nut elements.

4. A module claimed in claim 1 wherein said conductive panels have perimetrical lips in abutment with said base.

5. The floor construction claimed in claim 1 wherein said fastening means are embodied in fasteners having separable elements.

6. Floor construction for an amusement ride utilizing small electrically powered cars and including, floor modules each having a base and sheet metal panels thereon of positive or negative polarity, said sheet metal panels each including lips on their perimeter in abutment with their respective bases contributing toward panel retention thereon, conductors coupling said sheet metal panels of like polarity, and fastening means for retaining the sheet metal panels in place on their respective bases in a detachable manner permitting removal of one of said metal panels having a defect therein and the substitution of a replacement sheet metal panel.

* * * * *